United States Patent [19]

Studen

[11] 4,077,633

[45] Mar. 7, 1978

[54] GOLF PUTTER

[76] Inventor: George Studen, 17040 San Bruno, No. 4, Fountain Valley, Calif. 92708

[21] Appl. No.: 689,000

[22] Filed: May 26, 1976

[51] Int. Cl.[2] ..... A63B 53/04

[52] U.S. Cl. ..... 273/164; 273/169; 273/175

[58] Field of Search ..... 273/77 R, 164, 167–175, 273/183 D; D34/5 GH, 5 GC

[56] References Cited

U.S. PATENT DOCUMENTS

| | | | |
|---|---|---|---|
| Re. 19,178 | 5/1934 | Spiker | 273/167 J X |
| D. 180,602 | 7/1957 | Karns | 273/164 X |
| D. 205,041 | 6/1966 | Capps | 273/164 X |
| D. 216,137 | 11/1969 | Hemsoth | 273/164 X |
| D. 231,624 | 5/1974 | Wilmoth | 273/164 X |
| D. 237,289 | 10/1975 | Calton | 273/167 J X |
| 2,665,909 | 1/1954 | Wilson | 273/175 X |
| 2,781,197 | 2/1957 | Wiley | 273/164 |
| 2,954,231 | 9/1960 | MacIntyre | 273/164 |
| 3,989,256 | 11/1976 | Cicero | 273/167 J |
| 3,989,257 | 11/1976 | Barr | 273/175 |

FOREIGN PATENT DOCUMENTS

| | | | |
|---|---|---|---|
| 637,948 | 5/1950 | United Kingdom | 273/175 |
| 27,807 | 11/1912 | United Kingdom | 273/167 J |

*Primary Examiner*—Richard J. Apley
*Attorney, Agent, or Firm*—Gary Appel

[57] ABSTRACT

A golf putter comprises a putter head and a conventional handle shaft attached thereto. A golf ball striking face on the head is divided into two contiguous transverse face segments, the lower of which is slanted downwardly and backwardly at about 1°–7° and the upper of which is slanted upwardly and backwardly at about 1°–3°. The two face segments, which intersect along a line about 0.600 inches above the sole of the head, cause a line, rather than a point, contact with a ball being putted and also cause an overspin to a struck ball, both to improve directional control of the ball. Rapid visual alignment between a preselected striking region on the face and a ball to be putted is provided by a plurality of visually contrasting lines formed transversely across a top surface of the head parallel to the face and spanning the striking region. Ridges defining the contrasting lines are interrupted about a plane through the striking region center and orthagonal to the face and sole, a contrasting line pointing towards the striking region being thereby formed. The visual sighting effect may be enhanced by varying the length and/or the width of the contrasting lines in a regular manner as distance of the lines from the face increases.

3 Claims, 4 Drawing Figures

GOLF PUTTER

BACKGROUND OF THE INVENTION

1. Field of the Invention

The present invention relates to the field of golf clubs and more particularly to design of golf ball putters.

2. Description of the Prior Art

Golf club "irons" and "woods" do not vary substantially in design from manufacturer to manufacturer. The same cannot be said for golf ball putters which are available in an almost unlimitless variety and which are available separately from the rest of a set of clubs.

That there is such a wide variety in putter design and construction is indicative that the putting portion of golf is both difficult and frustrating, and that what constitutes a good putter is very subjective. Most non-casual golfers have favorite putters that they swear by so long as their putting is good. Yet when they are in a putting slump they frequently turn to a new or different type putter to cure their game. Other players who have never had a good putting game may go through a succession of putters looking for an elusive type which would help them.

Another apparent reason for the continual introduction of new and often relatively exotic, types of putters is that use of the latest type of putter is often considered a status symbol. The pride of ownership may actually stimulate a user's game for a time.

To meet this wide range of individual taste and preference in putters, as well as in genuine attempts to improve putter performance, all shapes and styles of putters are made. Still, regardless of design and construction a feature in common is that most, if not all, have a preformed face region designed for impacting the golf ball. Failure to hit the ball with this region usually causes slight to moderate twisting of the club and results in a misdirected ball. But, in order to be effective, provision must be made to enable the user to quickly and accurately align the preferred region, the ball to be hit and the cup or other target point over a wide range of lighting conditions ranging from bright sunlight to near darkness. Heretofore available putters have been deficient in providing such alignment means.

In addition, to accurately control the path of a putted golf ball, a predetermined amount of overspin should be imparted to the ball. Most known putters are, however, provided with flat striking faces which impart either no spin or else incorrect spin to the struck ball.

For these and other reasons, and in spite of the large variety of putters, available, improvements in putter design are still required to improve putter performance.

SUMMARY OF THE INVENTION

A golf putter, in accordance with a preferred embodiment, comprises an elongate putter handle having a gripping end and a mounting end and a putter head having top, bottom and rear surfaces and a front golf ball engaging face and including means for attaching the mounting handle to the head, the putter head face is non-planar and includes contiguous upper and lower transverse face segments, the lower segment slanting backwardly and downwardly at a first small angle relative to a plane orthagonal to the head bottom surface and the upper segment slanting backwardly and upwardly at a second small angle relative to the same plane. The head face is thereby formed at a large obtuse angle.

More specifically, the lower face segment is slanted at an angle in the approximate range of one to seven degrees and the upper face segment is slanted in the approximate range of one to three degrees. As a result, the obtuse angle of the face is in the approximate range of 182° to 190°. The intersection between the two face segments is located about 0.600 inches above the bottom surface of the head.

Visual alignment means are provided for enabling a user of the putter to quickly and easily align a preselected ball striking region on the head face with a ball to be putted. Such means includes a plurality of visually first contrasting lines formed on the head upper surface parallel to the striking face and spanning the preferred striking region. A second contrasting line is formed along a plane through the preselected striking region and orthogonal to the bottom surface.

The plurality of first contrasting lines may be formed to be of decreasing length and/or of increasing width as their distance from the head face is increased. All the contrasting lines may be formed by at least partially filling recessed regions with a material offering high visual contrast with adjacent portions of the head upper surface.

Because of the shape of the ball striking face, a ball being struck is contacted normally along the line between said intersection of the two face segments, thereby providing a line of contact between the ball and the putter head engaging faces. The angled nature of the obtuse angled face also imparts a preselected "overspin" to the struck ball. Both such factors substantially improve control of the struck ball.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENT

Figure 1:
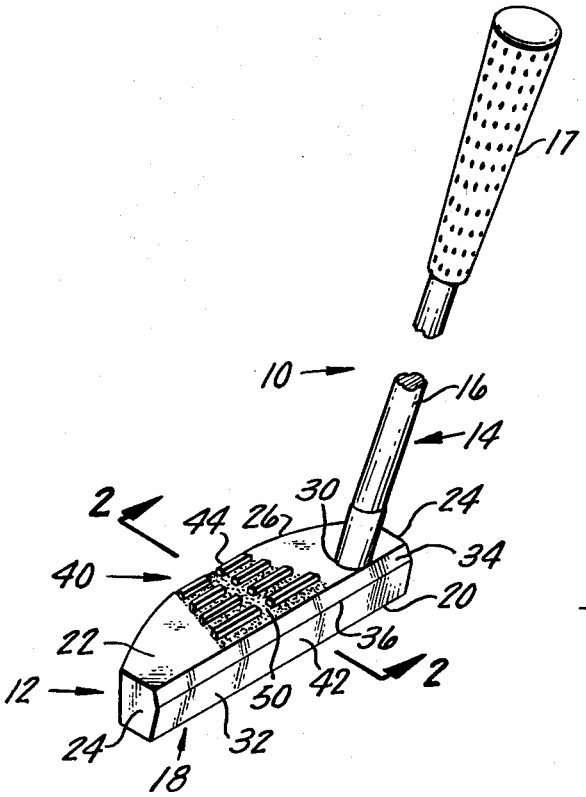
FIG. 1 is a perspective view of a golf ball putter, showing features of the putter head.

As seen in FIG. 1, a golf ball putter 10 comprises a putter head or hosel 12 attached to which is a putter handle 14 having an elongate, slender shaft portion 16 and an upper grip 17. The shaft portion 16 may be of any generally conventional configuration and construction. As such, the shaft portion 16 may be slightly bent near the point of attachment to the head 12 (as shown) or it may be completely straight or else "dog-legged" to place the grip 17 over the center of the head.

Figure 2:
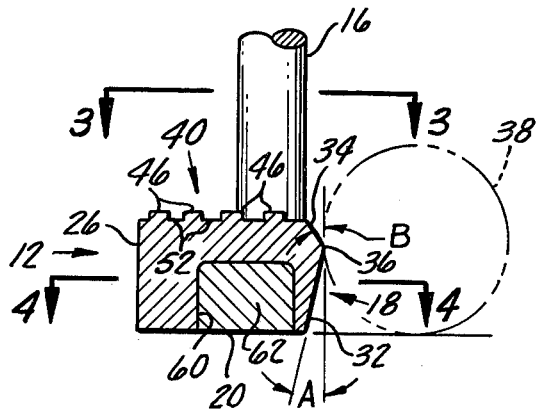
FIG. 2 is a cross sectional view along line 2—2 of FIG. 1, showing an angled ball engaging face and upper surface alignment markings.
Figure 3:
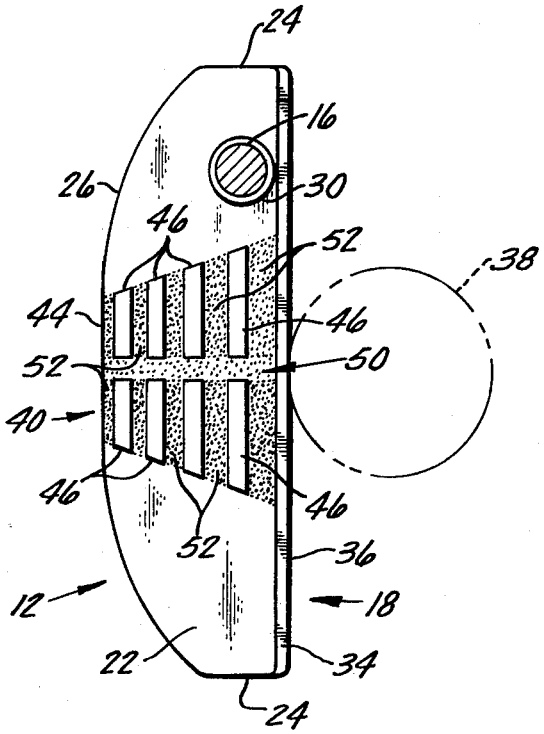
FIG. 3 is a top plan view taken along line 3—3 of FIG. 2, showing features of the alignment markings.

The putter head 12 is formed having a relatively long ball striking face 18, a substantially flat bottom surface or sole 20, an upper or top surface 22, ends 24 and a generally arcuate rear surface 26. A transverse cross section of the head 12 is generally rectangular. Preferably the head 12 is substantially longer than either its width or thickness (height), and has a recess 30 formed downwardly from the upper surface 22, near one end 24 and near the face 18, into which is received a lower end of the putter handle 14 (FIGS. 2 and 3). Positioning of the recess 30, as well as the angle of its axis relative to the upper surface 22, may vary, however, according to the configuration of the handle 14.

Although preferably straight from one end 24 to the other, the striking face 18 is non-planar, being formed of contiguous transverse lower and upper face segments 32 and 34, respectively. These segments 32 and 34, which are angled relative to each other, intersect along a common line or faired region 36.

As best seen in FIG. 2, the lower face segment 32 is slanted downwardly and backwardly relative to a plane orthogonal to the bottom surface 20, at a small angle (Angle "A") preferably in the range of about one to seven degrees. The upper face segment 34 is slanted upwardly and backwardly relative to the same plane, at a small angle (Angle "B") preferably in the range of about one to three degrees. Thus, the face 18 is formed in a large obtuse angle in the approximate range of 182 ° to 190°. The intersecting region 36 between the two segments 32 and 34 is preferably radiused with a radius from about 1/64 to ¾ of an inch and is positioned about 0.600 inches above the bottom surface 20, or at such distance above the bottom surface which is about equal or somewhat less than the radius of a golf ball 38 approximately 0.83 inches in radius for typical golf balls, with which the putter is to be used.

Because of the non-planar, obtuse angle configuration of the ball striking face 18, the ball 38 being struck is contacted preferably along the intersection between segments 32 and 34. In fact, because of the diameter of the ball 38, the ball is normally engaged during impact along a line or most of a line extending between ball contact point on the intersection of surface segments 32 and 34. This creates a line or, at the very least, more than point contact between the putter face 18 and the ball 38, providing a substantially greater "sweet spot" of contact than is provided by a planar ball striking surface. As a consequence, greater directional control of the putted ball is achieved. Additionally, due to the angling of the surface segments 32 and 34, the ball 38 is given an "overspin" as it is struck. This tends to cause the ball to roll along a straighter line than it otherwise would roll.

Another feature of the putter head 12 is provision of putter head alignment means 40 for enabling a user of the putter 10 to align a preselected region 42 of the striking face 18 — preferably at the mid point between the ends 24 — with the ball 38 before and as the ball is being putted. This ability for a user to effect such alignment is important because it not only enables the ball 38 to be struck by the particular region 42 of the putter face 18, which may, for example, be the center of percussion, but it enables, as well, the user to always strike the ball 38 with the same region of the club face each time the ball is struck. This latter assures repeatability in putting, once the user has gotten the feel of the putter 10.

To this end, a generally central region 44 of the head top surface 22 is formed having a plurality of raised ridges 44 parallel to the face 18 and transversely spaced from such face to the rear surface 26. These ridges 46 (four being shown) symmetrically span the selected impact region 42 by a substantial amount; for example, the ridge 46 which is closest to the face 18 may be about 2½ inches long.

Preferably all, but at least some, of the ridges 46 are formed having a narrow transverse interruption as groove 50 along a plane through the center of the impact region 42 and orthogonal to the face 18 and bottom surface 20. Thus, a line defined by the interruption 50 points directly towards the center of the impact region 42 and is clearly visible from above by a user holding the putter 10 in a normal, ball putting position.

To provide rapid, easy alignment of the ball 38 with the line of interruption 50 over a wide range of lighting conditions, the ridge interruption 50 and recessed regions 52 between the ridges 46 are at least partially filled with a material which provides a sharp visual contrast with adjacent portions of the ridges and the top surface 22. For example, if the ridge tops and the top surface 22 are silvery and shiny in appearance, the filling material used may be black and preferably non-shiny. On the other hand, if the ridge tops and top surface 22 are comparatively dark and dull colored, the filling material may be a shiny white material.

It is to be appreciated that any method of forming such contrasting lines on the top surface 22 may, however, be used. Instead of forming the region 44 with raised ridges, the region may be formed with slots or grooves which are then filled with a visually contrasting material, or all the contrasting lines may be painted or silk screened onto the top surface 22.

Rapid visual alignment between the impact region 42 and the ball 38 may be further enhanced by forming the ridges 46 of different lengths and/or with different separations. Thus, as seen in FIGS. 1 and 3, the length of each ridge 46 decreases uniformly as distance of the ridges from the face 18 increases. The ridge 46 closest to the face is therefore substantially longer than the ridge closest to the rear surface 26. Visual alignment is further facilitated by increasing the spacing between the ridges 46 as distance of the ridges from the face 18 increases. In this manner the filled recessed regions 52 increase in width as their distance from the face 18 increases, narrower recessed regions being closest to the face.

However, instead of the recessed regions 52 being shorter and/or wider as their spacing from the face 18 increases, a contrasting visual effect enhancing alignment of the ball 38 with the line 50 may be achieved by making the ridges 46 wider and/or spaced closer together as their distance from the face 18 increases, or, the ridges 46 may be made shorter and of increased spacing or made longer with decreased spacing, all of which are within the scope of the invention.

It is also within the scope of the invention that the clubs on which the alignment means 40 is employed need not necessarily be limited to golf ball putters. The alignment means 40 may, for example, be used on other golf clubs such as the "woods" which have relatively broad upper surfaces to accommodate the ridges 46 or other means for forming the contrasting lines. In addition the alignment means may be used to advantage on other similar types of clubs used to strike balls or other objects.

Figure 4:
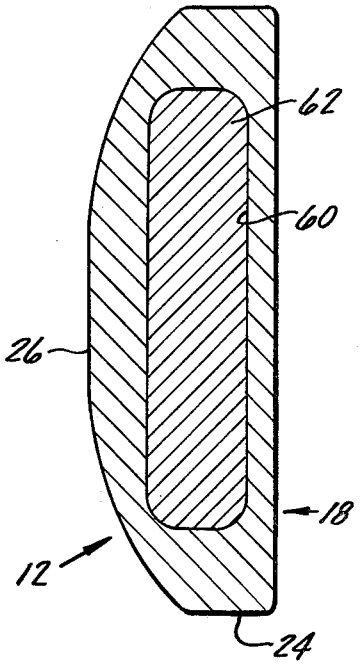
FIG. 4 is a horizontal sectional view along line 3—3 of FIG. 2, showing weighting of the club head.

As seen in FIGS. 2 and 4, the head 12 may be weighted to any preselected weight by installing into a large recess 60, formed upwardly into the head 12 from the bottom surface 20, a suitable weight or slug 62. Ordinarily the weight of the head 12 is increased by installing a heavy weight 62 in the recess 60; however, if the head is made of heavy material, it can be lightened by installing a weight of lesser density.

The head 12 may be of any overall size allowed by golf regulations; as an illustration, it may be about four inches long, 1¼ inches wide and ⅞ inches thick (high).

Although there has been described above a specific arrangement of a golf ball putter in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A golf ball putter, which comprises:

(a) an elongate putter handle having a first, gripping end and a second, mounting end, (b) a putter head having top, bottom and rear surfaces and a front, golf ball engaging face, and including means for enabling attachment of the mounting end of the handle to the putter head, said front face being non-planar and including contiguous upper and lower transverse face segments, said lower face segment being slanted downwardly and backwardly at a first preselected small angle from an intersection line with the upper face segment and relative to a plane orthogonal to the bottom surface, and said upper face segment being slanted upwardly and backwardly at a second preselected angle from said intersection line and relative to said plane, said upper and lower face segments thereby being formed at a large obtuse angle permitting engagement by the putter head of a golf ball along said intersection line, and permitting a preselected spin orientation to be imparted to the golf ball, and (c) visual alignment means on the upper head surface adapted for enabling a user of the putter to visually align a preselected golf ball striking region on the front face with a golf ball to be putted, said visual alignment means including means for defining a plurality of lines of contrasting appearances on the top surface of said head, said lines being generally parallel to an upper edge of the front face and spanning the region of said preselected striking spot by a substantial amount, said line defining means also including means for forming another contrasting line along a plane orthogonal to the front face and bottom surface and through the preselected striking region, said last mentioned contrasting line being generally orthogonal to the first mentioned lines of contrasting appearance and pointing directly towards the preselected striking region in a manner readily visible to a user holding the putter in a normal, golf ball putting manner, said plurality of lines contrasting appearance being formed symmetrically about said last mentioned contrasting line, and the lines of contrasting appearance being formed of progressively wider widths as distance of the lines from the front face is increased, the contrasting lines closest to the front face being thereby substantially narrower than the contrasting lines closest to the rear surface, the ability of a user to rapidly align the preselected striking point with a golf ball to be putted being thereby enhanced.

2. A golf club or the like for striking a ball, which comprises:

(a) a club handle having an upper gripping end and a lower mounting end, and (b) a club head having top, bottom and rear surfaces and a front, ball engaging face and including means for attaching the mounting end of the club handle to the club head, said club head including means for defining a plurality of first lines of contrasting appearance on the top surface generally parallel to the front face, said defining means also defining a second line of contrasting appearance in a plane orthogonal to the front face and bottom surface and through the center of a preferential ball striking region, said second line pointing towards said center in a manner readily visible to a user holding the club in a normal, ball striking manner, said first lines of contrasting appearance being formed symmetrically about said second line, the lines of contrasting appearance being formed to be progressively wider in width as the distance of the lines from the front face increases, the first lines closest to the front face being substantially narrower than the first lines closest to the rear surface, visual alignment between the preferential striking region and a ball being struck being thereby facilitated.

3. A golf club or the like for striking a ball, which comprises:

(a) a club handle having an upper gripping end and a lower mounting end, and (b) a club head having top, bottom and rear surfaces and a front, ball engaging face and including means for attaching the mounting end of the club handle to the club head, said club head including means for defining a plurality of first lines of contrasting appearance on the top surface generally parallel to the front face, said defining means also defining a second line of contrasting appearance in a plane orthogonal to the front face and bottom surface and through the center of a preferential ball striking region, said second line pointing towards said center in a manner readily visible to a user holding the club in a normal, ball striking manner, the first contrasting line defining means including means for forming alternating elevated and recessed regions parallel to the head face, said elevated regions being interrupted to define said second line of contrasting appearance, said recessed and interrupted regions being at least partially filled with a material with high visual contrast with the elevated regions.

* * * * *